US008839466B2

(12) United States Patent
Kosarnig

(10) Patent No.: US 8,839,466 B2
(45) Date of Patent: Sep. 23, 2014

(54) ACTUATION DEVICE FOR A DISCHARGE VALVE OF A FLUSHING DEVICE

(71) Applicant: Rolf Kosarnig, Ruti (CH)

(72) Inventor: Rolf Kosarnig, Ruti (CH)

(73) Assignee: Geberit International AG, Jona (CH)

( * ) Notice: Subject to any disclaimer, the term of this patent is extended or adjusted under 35 U.S.C. 154(b) by 0 days.

(21) Appl. No.: 13/862,754

(22) Filed: Apr. 15, 2013

(65) Prior Publication Data

US 2013/0291296 A1 Nov. 7, 2013

(30) Foreign Application Priority Data

May 3, 2012 (EP) ..... 12166622

(51) Int. Cl.

| | |
|---|---|
| ***E03D 5/09*** | (2006.01) |
| ***E03D 5/10*** | (2006.01) |
| ***E03D 5/092*** | (2006.01) |
| ***E03D 1/14*** | (2006.01) |

(52) U.S. Cl.

CPC *E03D 5/092* (2013.01); *E03D 5/10* (2013.01); *E03D 1/142* (2013.01)

USPC ..... 4/413

(58) Field of Classification Search

CPC ..... E03D 5/092
USPC ..... 4/300–413, 615, 619–660, 222
See application file for complete search history.

(56) References Cited

FOREIGN PATENT DOCUMENTS

| | | |
|---|---|---|
| EP | 0722020 A1 | 7/1996 |
| EP | 1493873 A2 | 1/2005 |

*Primary Examiner* — Lori Baker
(74) *Attorney, Agent, or Firm* — Sughrue Mion, PLLC

(57) ABSTRACT

An actuation device (1) for a discharge fitting of a flushing device that comprises a full flush lever (2) for initiating a full flush action, and a partial flush lever (3) for initiating a partial flush action. The full flush lever (2) can be moved from a neutral position to a full flush position, and the partial flush lever (3) can be moved from a neutral position into a partial flush position. The actuation device (1) has a motor (4), with an output element (5) that engages the full flush lever (2), or the partial flush lever (3), and provide a movement of the driven lever. The flush levers (2,3) are connected via a coupling element (6) such that the movement of the flush lever (2, 3) driven by the output element (5) can be transferred onto the other flush lever (3, 2) uncoupled from the output element (5).

16 Claims, 6 Drawing Sheets

ACTUATION DEVICE FOR A DISCHARGE VALVE OF A FLUSHING DEVICE

TECHNICAL FIELD

The present invention concerns an actuation device for a discharge valve of a flushing device for the purpose of selective initiation of a full flush action or a partial flush action in accordance with the preamble of Claim 1, and a cistern arrangement with an actuation device in accordance with Claim 10.

PRIOR ART

From the prior art flushing equipment for the purpose of initiating full flush actions and partial flush actions is of known art. EP 0 722 020, for example, shows flushing equipment of the type cited. In accordance with EP 0 722 020 a closure body is lifted off a valve seat, whereby the flush water can then be supplied from the cistern of the equipment to be flushed, such as for example, a water closet or a urinal. The closure body is lifted via two pulling elements or levers. Here one of the two pulling elements serves to initiate the partial flush action and the other of the two pulling elements serves to initiate the full flush action. For this purpose one or the other of the two pulling elements must in each case be actuated by an actuation unit. This actuation has usually been achieved in that two pulling elements are provided, which can be actuated via two actuation buttons.

After the lifting of the closure body the pulling elements move back into their initial positions, and the closure body is held open by means of a float. As soon as the water level in the cistern has fallen to an appropriate level, the closure body is closed, in the case of a partial flush action via a weight, and in the case of a full flush action via the ventilation of the float.

In summary it can therefore be said that the initiation procedure takes place with mechanical means, and that the closing procedure then takes place via the discharge fitting by means of floats and/or weights.

The initiation procedure usually has a relatively complex mechanism. This is disadvantageous because by virtue of the complexity the effort required for manufacture is relatively high, and moreover the susceptibility to faults in elements that have not been correctly fitted by installation technicians is likewise high.

From EP 1 493 873 a device is moreover of known art, which is driven by an electric motor. Here the electric motor is securely connected with the discharge valve. The opening of the discharge valve and also the closing of the discharge valve take place directly via the servomotor. Here the outflow quantity is essentially regulated as a function of time; this has the disadvantage that the desired discharge quantity cannot be manipulated manually. Furthermore this constrained coupling has also shown that uncontrolled forces act on the motor during the closing procedure; this has a negative effect on the service life of the latter.

PRESENTATION OF THE INVENTION

Based on this prior art the task underlying the invention is that of specifying an automatically driven, in particular, an electrically driven, actuation device with which a discharge fitting can be actuated in as simple a manner as possible. Furthermore the actuation device is to be designed to have as long a life as possible in terms of the number of actuations.

Such a task is solved by the actuation device in accordance with Claim 1. Accordingly an actuation device, for the actuation of a discharge fitting of a flushing device for the purpose of selective initiation of a full flush action or a partial flush action by the lifting of a closure body of the discharge fitting, comprises a full flush lever for the purpose of initiating a full flush action and a partial flush lever for the purpose of initiating a partial flush action. The full flush lever can be moved from a neutral position into a full flush position and the partial flush lever can be moved from a neutral position into a partial flush position. The actuation device further comprises a single drive, preferably a motor, in particular an electric motor or a servomotor, with an output element, which output element engages loosely with the full flush lever or the partial flush lever and serves to provide movement of the driven lever. The partial flush lever and the full flush lever are connected with one another via a coupling element such that the movement of the flush lever driven by the output element can be transferred onto the other flush lever that is uncoupled from the output element, or more particularly, is not directly connected with the output element.

Thus of the two flush levers it is either the partial flush lever, or the full flush lever, that is actively driven by the drive and the output element.

The inventive device has the advantage that the movement between the full flush lever and the partial flush lever is coupled via the coupling element, as a result of which a single drive can be arranged. By this means a device of a particularly simple design can be provided. Furthermore the drive always travels out of the neutral position to just two positions, namely the partial flush position, or the full flush position, a fact that significantly increases the service life of the drive.

A further advantage ensues from the fact that the output element just engages loosely with one of the two flush levers, that is to say, it is not in a secure connection with the same. The flush lever is preferably lifted against the force of gravity.

The actuation device preferably further comprises a switching element, with which the connection between the partial flush lever and the full flush lever provided by the coupling element can be released, whereby the switching element is located on the length between the neutral position and the full flush position, or between the neutral position and the partial flush position. The removal of the connection between the two flush levers has the advantage that one discharge fitting connected with both flush levers can simply be operated.

When the neutral position has been reached the coupling element latches again with the flush lever with which the coupling element is not connected, such that the connection between the two flush levers can again be made.

The coupling element is particularly preferably designed as a catch, which can be pivoted relative to the appropriate flush lever, whereby the other flush lever without the coupling element has a slave element, which enters into a latching connection with the catch.

The output element can preferably be brought into engagement with the full flush lever or the partial flush lever during the movement from the neutral position into the full flush position or into the partial flush position. In the neutral position the output element of the drive accordingly is not connected with the flush lever, and engages after actuation of the flush lever has taken place. Immediately after the desired flush position has been reached the output element can be moved into the neutral state, as a result of which the connection between output element and flush lever can again be released. Via the appropriate flush units, such as, for example, a full flush unit or a partial flush unit, the discharge fitting is held open for as long as necessary until the desired flush quantity has been extracted from the cistern.

The output element of the drive preferably engages on a lever section formed on the full flush lever or the partial flush lever.

The switching element is preferably provided in terms of a stop, against which the coupling element abuts during the movement, whereby when the stop has been reached the connection between the full flush lever and the partial flush lever can be released.

A cistern arrangement comprises an actuation device in accordance with the above description, a cistern with a wall bounding an interior, and with an inlet opening passing through the wall, and with an outlet opening passing through the wall with a valve set and a discharge fitting with a closure body in the interior, which closure body can be lifted, and in a closure position closes the outlet opening, whereby the closure body can be moved from the closure position into a flush position that releases the outlet opening. The discharge fitting comprises a full flush unit that can be actuated with the full flush lever, and a partial flush unit that can be actuated with the partial flush lever, which flush units are connected with the closure body. With actuation of a partial flush action the full flush unit is bypassed, or not actuated, and with actuation of a full flush action the partial flush unit is bypassed, or not actuated.

Further forms of embodiment are specified in the dependent claims.

BRIEF DESCRIPTION OF THE DRAWINGS

Preferred forms of embodiment of the invention are described in the following paragraphs with the aid of the drawings, which serve solely to provide explanation, and are not to be construed as limiting the invention. In the drawings.

DESCRIPTION OF PREFERRED FORMS OF EMBODIMENT

Figure 1:
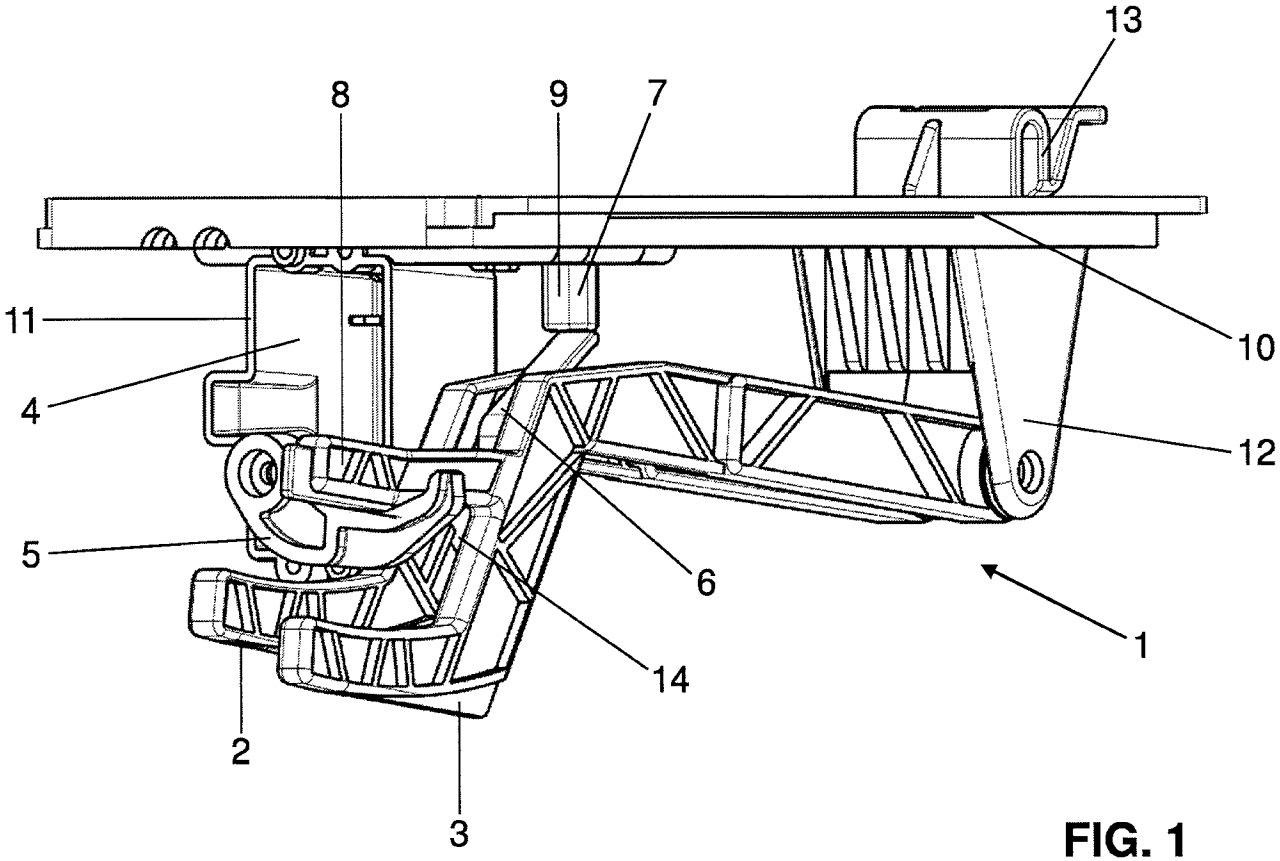
FIG. 1 shows a representation in perspective of one form of embodiment of the actuation device for purposes of actuating a discharge fitting of a flushing device.

FIG. 1 shows an actuation device 1 for the actuation of a discharge fitting of a flushing device. Here the actuation device 1 serves to provide selective initiation of a full flush action or a partial flush action. During the flush procedure a closure body of a discharge fitting arranged in a cistern is lifted off from a valve seat surrounding an outlet opening, such that flush water can flow out of the cistern. The closure body is therefore lifted from a closure position closing the outlet opening into a flush position, and after the extraction of flush water has taken place is moved back from the flush position into the closure position.

The actuation device 1 comprises essentially a full flush lever 2 for purposes of initiating a full flush action, and a partial flush lever 3 for purposes of initiating a partial flush action. In the case of a full flush action a larger quantity of water is extracted from the cistern than in a partial flush action.

Figure 8:
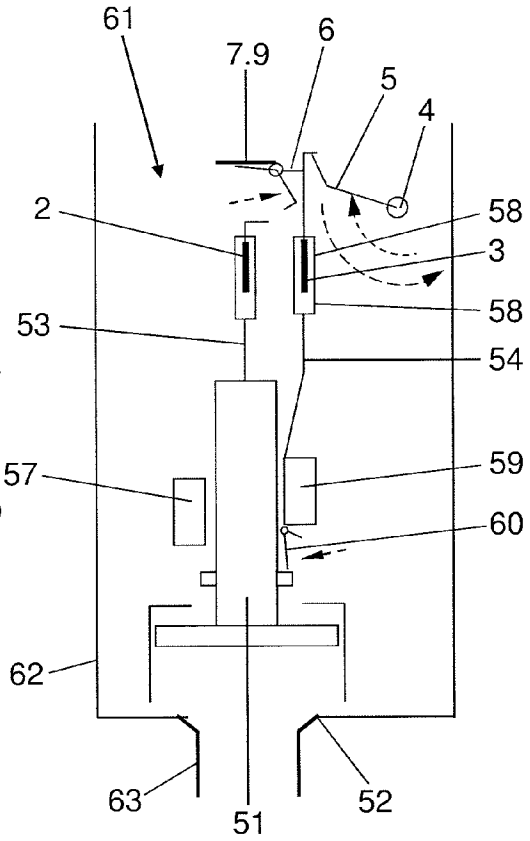
FIG. 8 shows the schematic view of the discharge fitting in accordance with FIG. 6 during the partial flush action.
Figure 7:
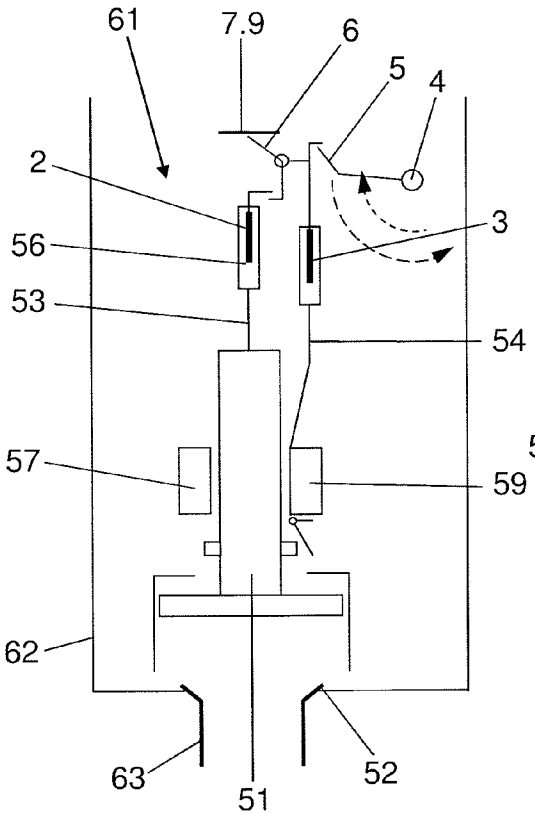
FIG. 7 shows the schematic view of the discharge fitting in accordance with FIG. 6 during the full flush action.
Figure 6:
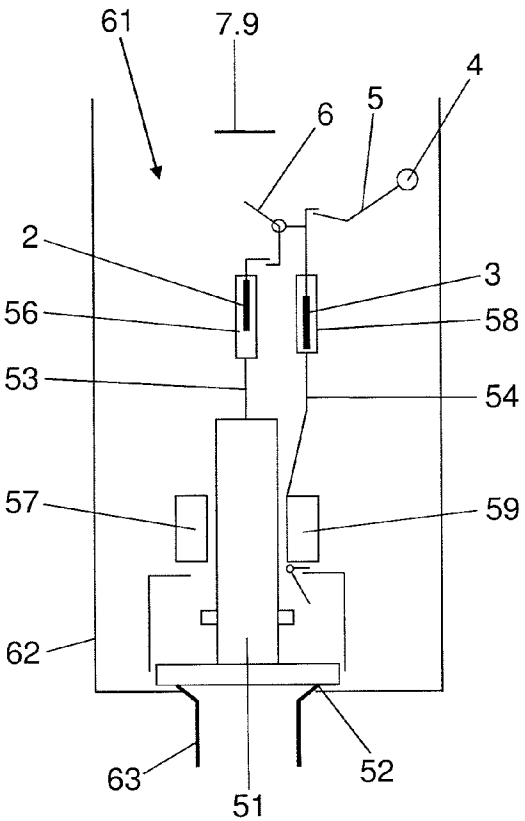
FIG. 6 shows a schematic view of a discharge fitting.

The discharge fitting to be actuated by means of the actuation device 1, as shown in FIGS. 6 to 8, comprises for the actuation of the closure body 51 a full flush unit 53 that can be actuated with a full flush lever 2 and a partial flush unit 54 that can be actuated with a partial flush lever 3. The flush units 53 and 54 are connected with the closure body 51 and hold the closure body 51 in the flush position for as long as necessary until the appropriate quantity of water has been extracted from the cistern.

The full flush lever 2 can be moved from a neutral position into a full flush position. During the movement of the full flush lever 2 into the full flush position the closure body 51 of the discharge fitting 50 is lifted off the closure position on the valve seat 52 into the flush position. The full flush unit 53 then holds the closure body 51 in the flush position until the appropriate quantity of water has flowed out of the cistern.

The partial flush lever 3 can likewise be moved from a neutral position into a partial flush position. In the case of a partial flush action the closure body 51 of the discharge fitting 50 is likewise lifted off the closure position on its valve seat 52 into the flush position. In an analogous manner to the full flush action, the partial flush unit 54 of the discharge fitting holds the closure body 51 in the flush position until the appropriate quantity of water has flowed out of the cistern.

The actuation device 1 further comprises a single drive 4, preferably in the form of a motor 4, with an output element 5. The output element 5, which is driven from the motor 4, engages with either the full flush lever 2 or the partial flush lever 3, and serves to provide the movement of the driven flush lever 2, 3. In the present form of embodiment the output element 5 engages with a lever section 8, which extends away from the partial flush lever 3. Here the output element 5 therefore engages with the partial flush lever 3.

In this context the expression "engage" or "loosely engage" is understood to mean that there is no fixed connection between the output element 5 and the appropriate flush lever 2, 3. Rather the output element 5 serves simply to lift the appropriate flush lever 2, 3 from its neutral position into the appropriate flush position. No fixed connection prevails between the connecting element 5 and the flush levers 2, 3.

During the movement from the neutral position into the full flush position, or into the partial flush position, the output element 5 is brought into engagement with the full flush lever 2 or the partial flush lever 3. In the neutral state the output element is not in engagement with the corresponding flush levers, which has the advantage that if necessary the flush action can also be initiated manually. Immediately after the desired flush position has been reached the output element 5 is moved back into the neutral state.

The drive can be designed in various ways. It preferably takes the form of an electric motor 4, in particular a servomotor. Alternatively the drive can be designed in another manner, for example, as a mechanical, pneumatic, or hydraulic drive. In the following paragraphs the expression "motor" is used to represent the drive, and to include all types of suitable drives.

The motor 4 travels out of the neutral position and into essentially two positions, namely the partial flush position and the full flush position. When the appropriate flush position has been reached the motor 4 then travels back again into the neutral state. The motor 4 is activated via appropriate communications elements. The communications elements are connected with an actuation plate, not shown. The user actuates the actuation plate, and a signal is generated via the communications lines to the motor 4. Depending upon the actuation of the actuation plate the signal is associated with a partial flush or a full flush.

With respect to the water level as seen in a cistern, the two flush levers are located at different heights; the full flush lever is preferably located above the partial flush lever. In this manner the two flush positions can differ from one another and a prioritisation of the flush action is possible.

The partial flush lever 3 and the full flush lever 2 are connected with a coupling element 6, such that the movement of the flush lever 2, 3 driven by the output element 5 can be transferred onto the other flush lever 2, 3 that is uncoupled from the output element 5 and is not being directly driven by the latter.

In the present form of embodiment the output element 5, as has already been mentioned above, engages with the partial flush lever 3. Accordingly the movement is transferred from the output element 5 onto the partial flush lever 3, and then from the latter, via the coupling element 6, to the full flush lever 2. Furthermore by virtue of the coupling between the two flush levers 2, 3 a single motor is provided. Accordingly one output element 5 therefore lifts both flush levers 2, 3, and with this one element and the motor 4 both the full flush quantity and also the partial flush quantity can be initiated. By this means the mechanical composition of an actuation device is significantly simplified.

In operation, which is explained in more detail further below in conjunction with FIGS. 2 to 5, the motor 4 essentially travels to two positions; on the one hand the partial flush position and on the other hand the full flush position. Shortly after the appropriate flush position has been reached the motor 4 travels back into the initial state and the discharge fitting is held open via the full flush unit 53 and the partial flush unit 54, until the appropriate quantity of flush water has flowed out of the cistern. In other words this means that while the motor 4 does indeed serve to actuate the two flush levers 2, 3, it does not serve the purpose of holding open the discharge fitting over the time required for the appropriate flush action. This holding open of the discharge fitting is provided exclusively by the discharge fitting and its units 53 and 54.

The actuation device 1 further comprises a switching element 7. With the switching element 7 the coupling between the partial flush lever 3 and the full flush lever 2 provided by the coupling element 6 can be lifted. Here the switching element 7 can be located on the length between the neutral position and the full flush position, or between the neutral position and the partial flush position. The removal of the connection between the partial flush lever 3 and the full flush lever 2 has the advantage that the two flush levers, that is to say the full flush lever 2 and the partial flush lever 3 are designed such that they can be separated from one another, as a result of which the functionality of the actuation device 1 is significantly improved. This is explained in more detail in conjunction with the description of FIGS. 2 to 9.

In this form of embodiment the coupling element 6 is arranged between the full flush lever 2 and the partial flush lever 3. The coupling element 6 is preferably connected with the partial flush lever 3. The coupling element 6 is preferably mounted such that it can be rotated or pivoted relative to the corresponding flush lever.

The switching element 7 is preferably provided in terms of a stop 9. The coupling element 6 abuts against this stop 9 during the movement, whereby when the stop 9 is reached the connection between the full flush lever 2 and the partial flush lever 3 can be released.

From FIG. 1 it can furthermore be discerned that here the device comprises a mounting element 10. The mounting element 10 essentially serves to provide mountings for the appropriate elements of the actuation device 1. Accordingly the mounting element 10 provides a mounting for the mounting of the full flush lever 2 and the partial flush lever 3 such that they can pivot, a mounting 11 for the motor 4 and the switching element 7, i.e. the stop 9. Here the full flush lever 2 and the partial flush lever 3 are mounted such that they can rotate about a common central axis M on a mounting lug 12.

The mounting element 10 furthermore comprises an optional suspension section 13, with which the mounting element 10 can be suspended in a cistern.

In the present form of embodiment the function of the full flush lever is assigned to the one flush lever, and the function of the partial flush lever is assigned to the other flush lever. The functions can also be exchanged such that the flush lever designated above as the full flush lever is provided for the partial flush quantity, and vice versa.

Figure 2B:
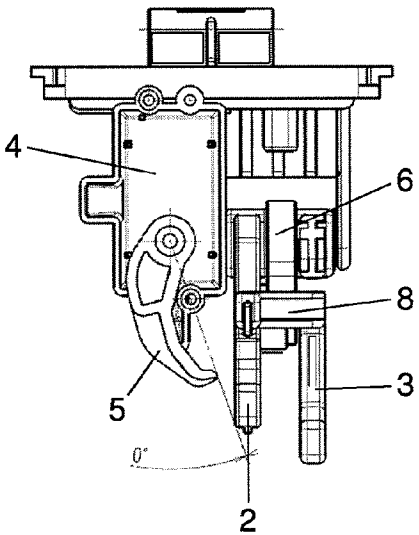
FIG. 2*b* shows a frontal view of FIG. 2*a;*
Figure 2A:
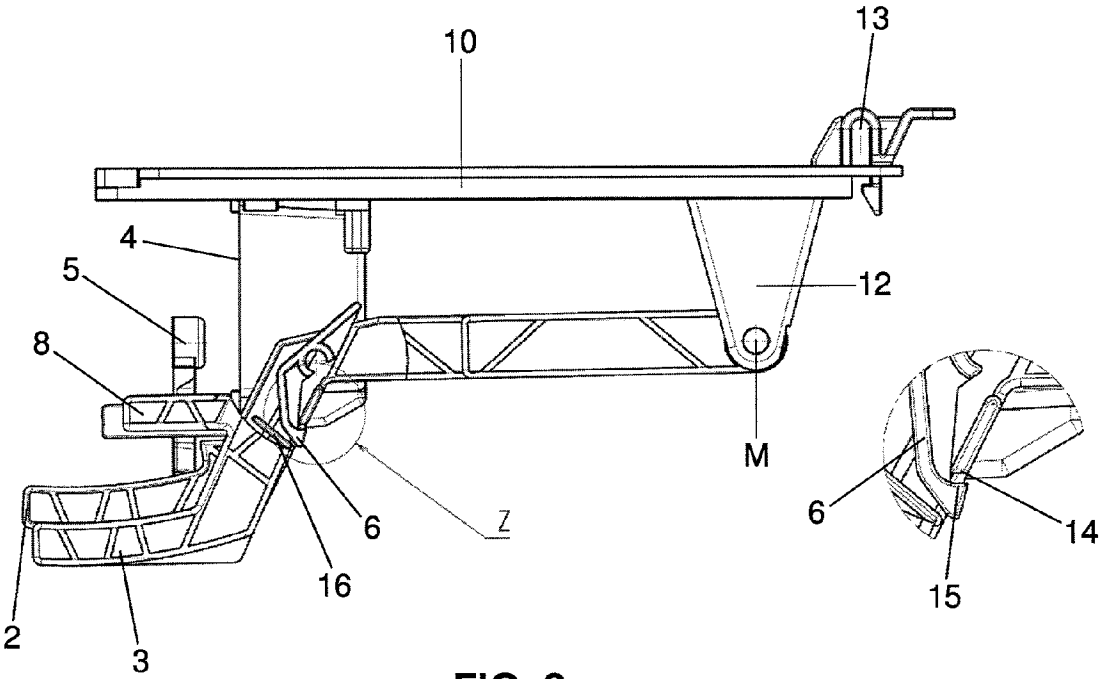
FIG. 2*a* shows a side view of the actuation device in accordance with FIG. 1, together with a detail.

The actuation of the actuation device 1 is now explained with the aid of FIGS. 2 to 5;

In FIG. 2*a* and FIG. 2*b* all elements are located in the neutral position. Here the output element 5 is located outside the range of movement of the two flush levers 2, 3. In FIG. 2*a* moreover the partial flush lever 3 is represented partially sectioned in the region of the coupling element 6 such that the view onto the coupling element 6 is unrestricted.

The coupling element 6, as already explained, is connected with the partial flush lever 3, and here latches on a slave element 14, which is connected with the full flush lever 2, such that when the two levers 2, 3 move they are coupled with one another. This is shown more precisely in Detail Z, where it is easy to see that here the coupling element 6 has a slave section 15, which is correspondingly connected with the slave element 14, or more particularly, enters into engagement with the slave element 14, as soon as the two levers 2, 3 move from the neutral state into the flush position.

In FIG. 2*a* it can also be seen that the flush lever that is not connected with the coupling element 6 features a motion link 16. This motion link 16 serves to provide feedback to the coupling element 6 after actuation has taken place. With the movement from the flush position into the neutral position the coupling element 6 will re-enter into engagement with the slave element 14 via the motion link 16.

Figure 3B:
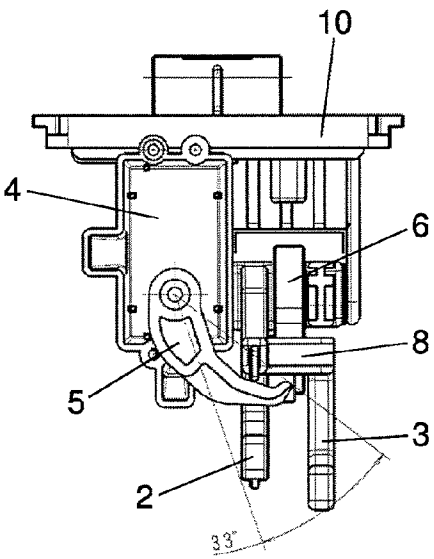
FIGS. 3*a/b* show views in accordance with FIGS. 2*a/b*, whereby parts of the actuation device are located in another setting.
Figure 3A:
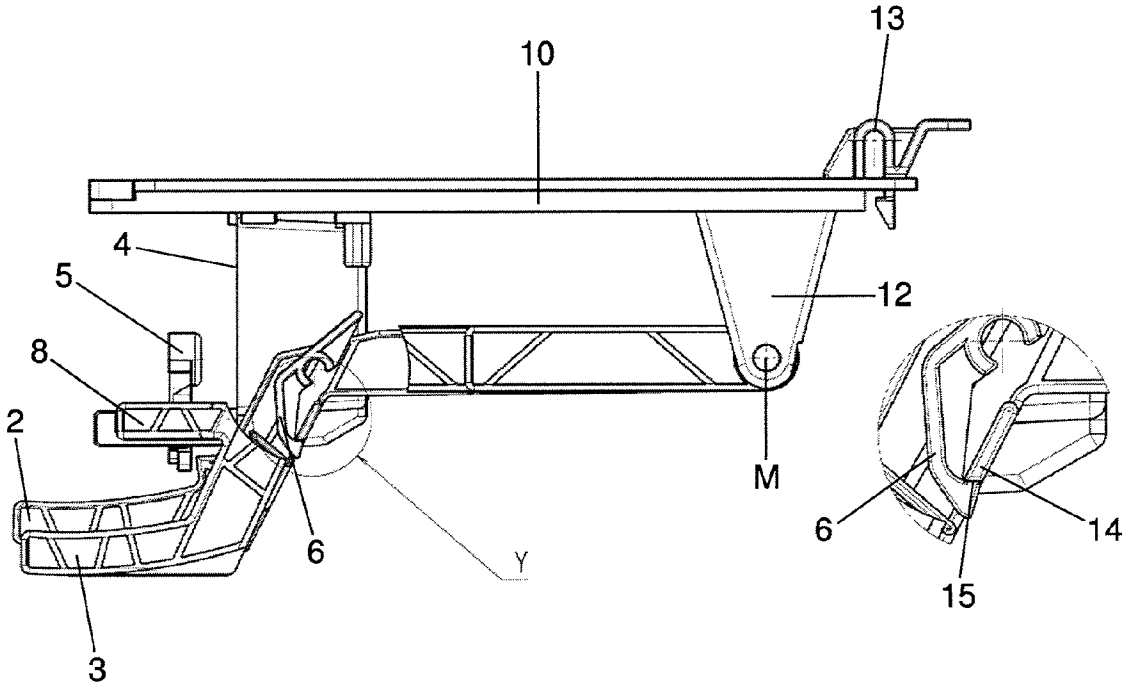

In FIGS. 3*a* and 3*b* the position of the output element 5 is shown shortly after initiation of the flush action. Here the output element 5 driven by the motor 4 has already pivoted towards the lever section 8 and is engaging with this lever section 8. The output element 5 hereby lifts the lever section 8 and thus the full flush lever 2 and also the partial flush lever 3 are correspondingly lifted. As explained above, the lever section 8 is here formed on the partial flush lever 3 and the movement of the partial flush lever 3 is transferred via the coupling element 6 to the full flush lever 2.

In Detail Y of FIG. 3*a* it can also be seen that the coupling element 6 is engaged with the slave element 14 of the full flush lever 2. By this means the movement is appropriately transferred.

Figure 4B:
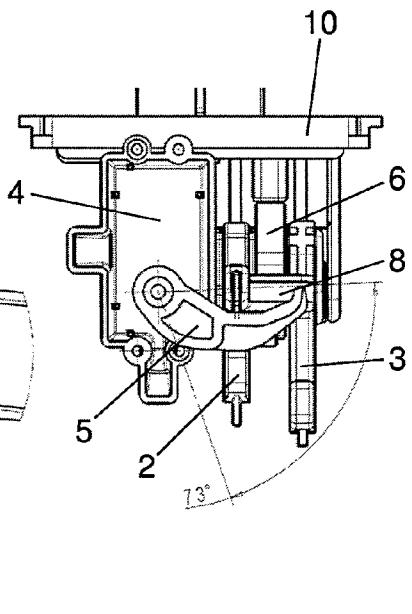
FIGS. 4*a/b* show views in accordance with FIGS. 2*a/b*, whereby parts of the actuation device are located in another setting.
Figure 4A:
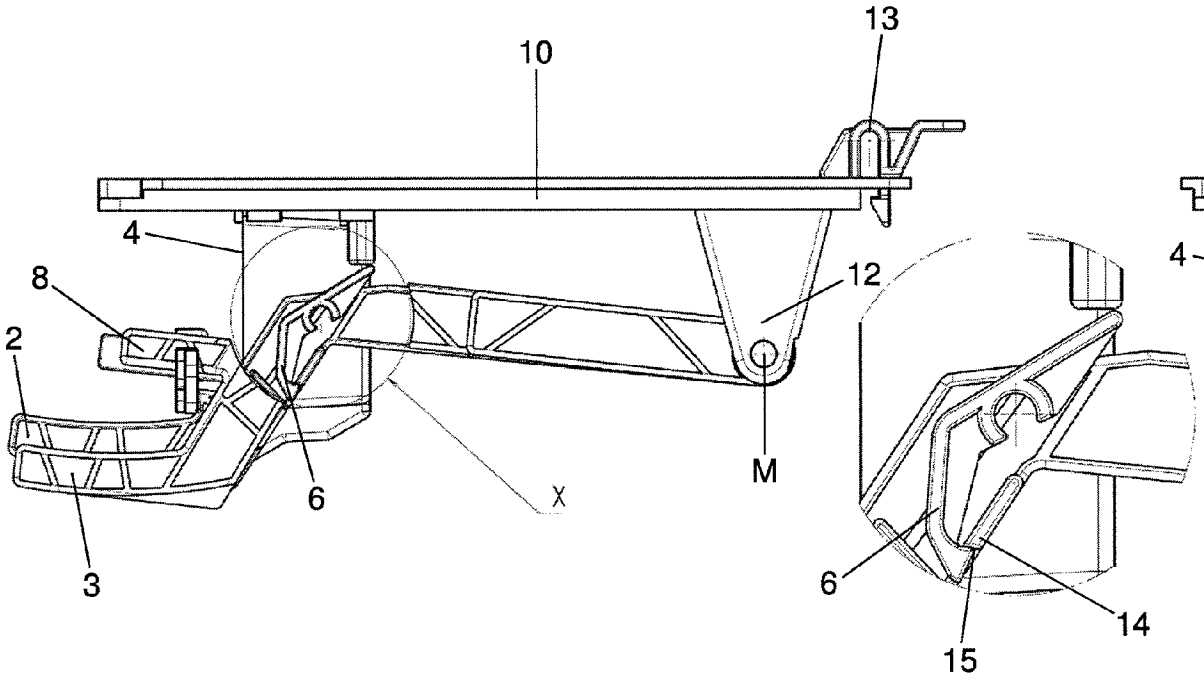

FIGS. 4*a* and 4*b* show the output element 5 in the full flush position. The full flush lever 2 has thus reached its end state, that is to say, the full flush position 2. With reference to the discharge fitting with the closure body it should here be mentioned that the full flush unit 53 has now likewise reached the position determined for the full flush action and thus the closure body is arranged at an appropriate distance from the valve seat. The closure action, that is to say, the reverse movement of the closure body onto the valve seat, thereby preferably takes place controlled as a function of level, that is to say, that if the level of the flush water has reached a predetermined lower level the closure body automatically moves back onto the valve seat.

Immediately after the full flush position has been reached the output element 5 is moved back into the neutral state.

The full flush action accordingly takes place without any decoupling between the full flush lever 2 and the partial flush lever 3. On the one hand this is possible by virtue of the design of the discharge fitting, either because the partial flush unit by virtue of its arrangement has not been actuated, or else because the said elements have been bypassed. On the other hand, as can easily be seen from the figures, the full flush lever 2 can be located with respect to the water level in the cistern with an offset above the partial flush lever 3. This offset has the effect that the full flush action has priority over the partial flush action, because when the full flush position has been reached the partial flush position has not yet been reached.

Figure 5B:
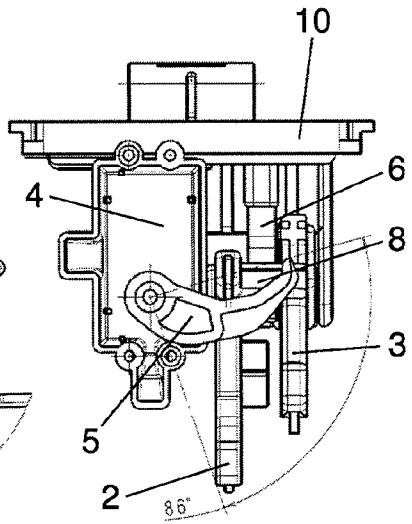
FIGS. 5*a/b* show views in accordance with FIGS. 2*a/b*, whereby parts of the actuation device are located in another setting.
Figure 5A:
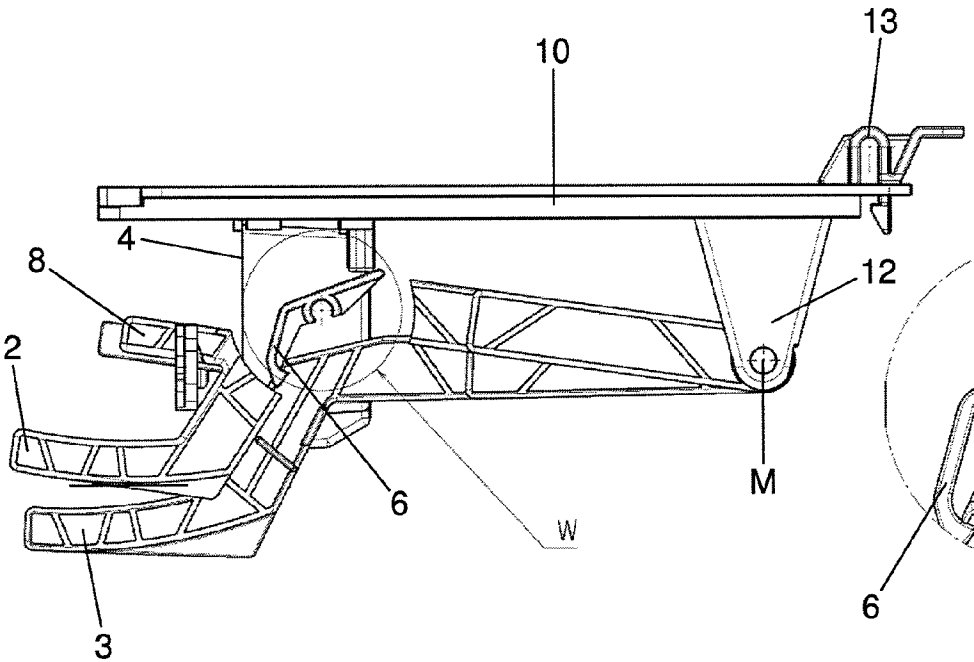

In FIGS. 5*a* and 5*b* the initiation of the partial flush action is correspondingly explained.

En route into the partial flush position the coupling element 6 comes into contact with the switching element 7. The coupling between the full flush lever 2 and the partial flush lever 3 is hereby correspondingly released. This can easily be seen in Detail W of FIG. 5*a*. After the decoupling of the two flush levers 2, 3 the full flush lever 2 thereby returns immediately to the neutral position. The partial flush lever 3 is then moved further into the partial flush position. The partial flush unit 54 is then correspondingly actuated and holds the closure body 51 in the upper position for as long as necessary until the partial flush action has accordingly taken place. After the partial flush position has been reached, however, the partial flush lever 3 and the output element 5 immediately move back into the corresponding neutral state.

With regard to the full flush unit 53 it should be noted that this is correspondingly bypassed, i.e. is not connected, i.e. is not actuated, if the partial flush action is initiated. In other words, that is to say, when the full flush lever 2 travels past the full flush position the full flush unit 53 on the discharge fitting 50 is accordingly disconnected, i.e. is bypassed.

With the aid of FIGS. 6 to 8 an example of a discharge fitting 50 that can be actuated with the above-described actuation device is now described in more detail. The discharge fitting 50 can also be designed in another manner. In FIGS. 6 to 8 the elements of the actuation device are shown schematically.

FIG. 6 shows the discharge fitting 50 in the closed setting. The closure body 51 is thereby in contact with the valve seat 52 of the cistern 55 and is located in the closed position.

The full flush action is explained with reference to FIGS. 6 and 7. The full flush lever 2 engages with a lug 56 of the full flush unit 53. Via the full flush unit 53, which is connected with the closure body 51, the closure body 51 is then lifted off the valve seat 52. This is illustrated in FIG. 7. With the initiation of the flush action the motor 4 is actuated and thus the output element 5 is pivoted into the full flush position in accordance with FIG. 7. The output element 5 thereby acts on the partial flush lever 3 and via the coupling element 6 the movement is transferred onto the full flush lever 2. The full flush lever 2 then lifts the closure body 51 via the full flush unit 53. Immediately after the full flush position has been reached the output element 5 and the full flush lever 2 are pivoted back into the neutral state and the full flush unit 53 holds the closure body 51 in the flush position. For this purpose the full flush unit 53 can, for example, comprise a latching element coupled with a float 57. The latching element provides a stop for the closure body 51 in the full flush position against the movement in the direction of the valve seat 52. As soon as the water in the cistern has fallen below the float 56 the lifting force generated by the water is removed and the latching element is actuated such that the stop for the closure body 51 is removed and the latter moves into the closure position.

In the case of a full flush action the partial flush unit 53 is similarly lifted. Here, however, the lift of the partial flush unit 53 is too small to enable the partial flush unit 53 to be actuated, i.e. connected. If the lift in the case of the full flush action were larger, the partial flush unit 53 would not be connected.

The partial flush action is explained with reference to FIGS. 6 and 8. The partial flush lever 3 engages in a lug 58 of the partial flush unit 54. Via the partial flush unit 54, which is connected with the closure body 51, the closure body 51 is then lifted off the valve seat 52. This is illustrated in FIG. 8. With the initiation of the flush action the motor 4 is actuated and thus the output element 5 is pivoted into the partial flush position in accordance with FIG. 8. The output element 5 thereby acts on the partial flush lever 3 and via the coupling element 6 the movement is also transferred onto the full flush lever 2. On reaching the switching element 7, i.e. the stop 9, the coupling between the full flush lever 2 and the partial flush lever 3 is released. The partial flush lever 3 is moved further by the output element 5 into the partial flush position, and the full flush lever 2 moves automatically back into the neutral state. Here the full flush unit 53 is not activated or connected, although the full flush position is passed during the movement of the closure body 51. Immediately after the partial flush position has been reached the output element 5 is pivoted back into the neutral state, and the partial flush unit 54 holds the closure body 51 in the flush position. For this purpose the partial flush unit 54 can, for example, comprise a latching element coupled with a float 59. The latching element provides a stop for the closure body 51 in the partial flush position against movement in the direction of the valve seat 52. As soon as the water in the cistern has fallen below the float 59 the lifting force generated by the water is removed and the latching element is actuated such that the stop for the closure body 51 is removed, and the latter moves into the closure position.

The float 59 could also be a closing weight, in which case the function of the device would be somewhat different.

For the disconnection of the full flush unit 53 or the partial flush unit 54 the flush units 53, 54 are provided, for example, with a switching device, which latches on a counterpart that is preferably fixed in location in the cistern 55, such that the appropriate flush action is not actuated.

The full flush action and the partial flush action in the discharge fitting can also be embodied in terms of the device in EP 0 722 020.

REFERENCE SYMBOL LIST

1 Actuation device
2 Full flush lever
3 Partial flush lever
4 Motor, servomotor
5 Output element
6 Coupling element
7 Switching element
8 Lever section
9 Stop
10 Mounting element

11 Mounting
12 Mounting lug
13 Suspension section
14 Slave element
15 Slave section
16 Motion link
50 Discharge fitting
51 Closure body
52 Valve seat
53 Full flush unit
54 Partial flush unit
55 Cistern
56 Lug
57 Float
58 Lug
59 Float
60 Latching element
61 Interior
62 Wall
63 Outlet opening

The invention claimed is:

1. An actuation device, for the actuation of a discharge fitting of a flushing device for the purpose of selective initiation of a full flush or a partial flush by the lifting of a closure body of the discharge fitting, comprising:

a full flush lever for the purpose of initiating a full flush, which full flush lever can be moved from a neutral position into a full flush position;

a partial flush lever for the purpose of initiating a partial flush, which partial flush lever can be moved from a neutral position into a partial flush position;

a single drive with a moveable output element, which moveable output element during movement engages loosely with either the full flush lever or the partial flush lever, and serves to provide movement of the engaged flush lever; and a coupling element via which the partial flush lever and full flush lever are connected with one another such that movement of the flush lever driven by the output element can be transferred onto the other flush lever that is uncoupled from the output element.

2. The actuation device according to claim 1, wherein said drive is a motor.

3. The actuation device according to claim 1, wherein the device further comprises a switching element, with which the connection between partial flush lever and full flush lever provided by the coupling element can be released, wherein the switching element is located along a length between the neutral position and the full flush position, or between the neutral position and the partial flush position.

4. The actuation device according to claim 1, wherein the output element can be brought into engagement with the full flush lever or the partial flush lever during movement from the neutral position into the full flush position, or into the partial flush position, and wherein immediately after the desired flush position has been reached the output element can be moved back into the neutral state.

5. The actuation device according to claim 1, wherein the distance traveled by the full flush lever from its neutral position into the full flush position is less than a distance traveled by the partial flush lever from a neutral position into the partial flush position, wherein the distance traveled by the flush lever to the switching point is greater than a distance traveled by the full flush lever from a neutral position into the full flush position.

6. The actuation device according to claim 1, wherein the output element of the single drive engages with a lever section formed on the full flush lever, or on the partial flush lever.

7. The actuation device according to claim 1, wherein the coupling element is arranged between the full flush lever and the partial flush lever, wherein the coupling element is connected preferably with the full flush lever such that it can pivot.

8. The actuation device according to claim 1, wherein the switching element is provided by a stop, against said stop the coupling element abuts during movement, wherein, when said stop is reached, the connection between the full flush lever and the partial flush lever can be released.

9. The actuation device according to claim 1, wherein when a neutral position is reached the coupling element latches again with the flush lever with which the coupling element is not connected, such that the connection can again be made between the two flush levers.

10. The actuation device according to claim 1, wherein the coupling element is designed as a catch, which is mounted such that it can be pivoted relative to the appropriate flush lever, wherein the other flush lever without the coupling element has a slave element, which enters into a latching connection with the catch, wherein said latching connection can appropriately be released.

11. The actuation device according to claim 1, wherein the device further comprises a mounting element, wherein the mounting element has a mounting for the mounting of the full flush lever and the partial flush lever such that each lever can pivot, a mounting for the drive and, if required, the switching element, i.e. the stop, and the mounting element comprises an optional suspension section, with which the mounting element can be suspended in a cistern.

12. The actuation device according to claim 2, wherein the motor is a servomotor, which travels out of the neutral position and into two positions, the partial flush position and the full flush position.

13. A cistern arrangement comprising:

an actuation device according to claim 1, and a cistern with a wall bounding an interior, and with an inlet opening passing through the wall, and with an outlet opening with a valve seat passing through the wall, and a discharge fitting with a closure body that can be lifted in the interior, and in a closure position closes the outlet opening, wherein the closure body can be moved from the closure position into a flush position that releases the outlet opening, wherein the discharge fitting comprises a full flush unit that can be actuated with the full flush lever, and a partial flush unit that can be actuated with the partial flush lever, which flush units are connected with the closure body, and wherein with actuation of the partial flush action the full flush unit is bypassed or not actuated, and with actuation of the full flush action the partial flush unit is bypassed or not actuated.

14. The cistern arrangement in accordance with claim 13, wherein, if the closure body is moved past the full flush position in the direction of the partial flush position, the full flush unit latches with a switching device on a counterpart that is preferably fixed in location in the cistern, such that the full flush action is not actuated, and/or wherein if the closure body is moved past the partial flush position in the direction of the full flush position, the partial flush unit latches with a switching device on a counterpart that is preferably fixed in location in the cistern, such that the partial flush action is not actuated.

15. The cistern arrangement in accordance with claim 13, wherein the partial flush lever in the installed state is arranged above the full flush lever as seen in terms of a direction of a force of gravity, or wherein the full flush lever in the installed state is arranged above the partial flush lever as seen in terms of a direction of a force of gravity.

16. The actuation device according to claim 1, wherein said movement of the driven flush lever is against a force of gravity.

* * * * *